US008012410B2

(12) United States Patent
Shah

(10) Patent No.: US 8,012,410 B2
(45) Date of Patent: Sep. 6, 2011

(54) HIGH SILICON NIOBIUM CASTING ALLOY AND PROCESS FOR PRODUCING THE SAME

(75) Inventor: Bipin H. Shah, White Fish Bay, WI (US)

(73) Assignee: Grede LLC, Southfield, MI (US)

( * ) Notice: Subject to any disclaimer, the term of this patent is extended or adjusted under 35 U.S.C. 154(b) by 452 days.

(21) Appl. No.: 12/066,974

(22) PCT Filed: Sep. 15, 2005

(86) PCT No.: PCT/US2005/032975

§ 371 (c)(1),
(2), (4) Date: Mar. 14, 2008

(87) PCT Pub. No.: WO2007/040464

PCT Pub. Date: Apr. 12, 2007

(65) Prior Publication Data

US 2008/0260568 A1 Oct. 23, 2008

(51) Int. Cl.
*C22C 37/10* (2006.01)
*C22C 37/08* (2006.01)

(52) U.S. Cl. ..... 420/27; 420/13; 420/16; 420/17; 420/18; 420/32; 420/33

(58) Field of Classification Search ..... 148/543–545, 148/617, 618, 321; 420/13–33
See application file for complete search history.

(56) References Cited

U.S. PATENT DOCUMENTS

| | | | |
|---|---|---|---|
| 3,893,873 | A | 7/1975 | Hanai et al. |
| 4,435,226 | A | 3/1984 | Neuhauser et al. |
| 5,330,705 | A | 7/1994 | Culling |
| 5,894,010 | A | 4/1999 | Porkert et al. |
| 6,013,141 | A | 1/2000 | Nylen et al. |
| 6,436,338 | B1 | 8/2002 | Qiao |
| 6,508,981 | B1 | 1/2003 | Perrin et al. |
| 6,800,152 | B2 | 10/2004 | Gundlach et al. |
| 6,911,098 | B2 | 6/2005 | Yazawa et al. |
| 2005/0238526 | A1 | 10/2005 | Schall |

FOREIGN PATENT DOCUMENTS

| | | | |
|---|---|---|---|
| BE | 1991/000001168 | | 8/1994 |
| CA | 2448213 | | 11/2002 |
| DE | 1482724 | | 8/1977 |
| DE | 1500766 | | 2/1978 |
| GB | 1218035 | | 1/1971 |
| JP | 61157655 | | 7/1986 |
| JP | 62142745 | * | 6/1987 |
| JP | 62142745 A | | 6/1987 |
| JP | 6372850 | * | 4/1988 |
| JP | 63072850 A | | 4/1988 |
| JP | 2003-221639 | | 8/2003 |
| WO | PCT/US96/09181 | | 12/1996 |
| WO | WO 2006/121826 | | 11/2006 |

OTHER PUBLICATIONS

"Microstructures and Heat treatments", Foundry Practice for Ferrous Alloys, pp. 1-3, Thomas S. Piwonka, The University of Alabama, 2002 ASM Handbooks online, http://products.asminternational.org.*

"Heat Treatment", Introduction to Cast Irons, pp. 1-8,G.M, Goodrich, Casting, vol. 15, ASM International, 2008, ASM Handbooks online, http://products.asminternational.org.*

English translation of Japanese patent 62142745,Suzuki, Masami, Jun. 26, 1987.*

English translation of Japanese patent 6372850, Hibino, Yoshihiro, Apr. 2, 1988.*

ASM International, Materials Park, Ohio, "Table 1.1 Essential and Incidental Elements in Steel and Cast Iron," Introduction to Steels and Cast Irons, p. 3, 1999.*

European Patent Office Communication Pursuant to Article 94(3) EPC regarding European Patent Application No. 05858417.8, mailed on Aug. 13, 2010.

Extended European Search Report regarding European Patent Application No. 05858417.8, mailed on Aug. 6, 2009.

Chinese State Intellectual Property Office Action regarding Chinese Patent Application No. 200580051593.3, mailed on Dec. 24, 2010.

English Translation of Dec. 24, 2010 Chinese State Intellectual Property Office Action regarding Chinese Patent Application No. 200580051593.3.

Chinese State Intellectual Property Office Action regarding Chinese Patent Application No. 200580051593.3, mailed on Dec. 4, 2009.

English Translation of Dec. 4, 2009 Chinese State Intellectual Property Office Action regarding Chinese Patent Application No. 200580051593.3.

Partial English Translation of JP 63072850 A.

Partial English Translation of JP 62142745 A.

Partial English Translation of JP 63072850 A to Yoshihiro Hibino published Apr. 2, 1988.

Partial English Translation of JP 62142745 A to Masami Suzuki published Jun. 26, 1987.

* cited by examiner

*Primary Examiner* — Deborah Yee
(74) *Attorney, Agent, or Firm* — Quinn Law Group, PLLC

(57) ABSTRACT

An iron-based high-silicon alloy contains (in weight percent) 2.6-3.5% carbon, 3.7-4.9% silicon, 0.45-1.0% niobium, up to 0.6% manganese, up to 0.02% sulfur, up to 0.02% phosphorus, up to 0.5% nickel, up to 1.0% chromium, up to 0.1% magnesium, and the balance iron and up to 0.2% of other elements. The alloy is heat resistant and is suitable for use in producing, among other things, turbochargers, center housings, back plates, exhaust manifolds, and integrated turbo manifolds that are used in the automotive and truck manufacturing industries.

2 Claims, 13 Drawing Sheets

HIGH SILICON NIOBIUM CASTING ALLOY AND PROCESS FOR PRODUCING THE SAME

FIELD OF THE INVENTION

This invention relates generally to iron-based casting alloys and particularly to those having high silicon content. It also relates generally to processes for producing such alloys. More specifically, it relates to an improved iron-based, high silicon niobium alloy that demonstrates enhanced high temperature strength and performance characteristics. It also specifically relates to the process for producing this improved alloy.

BACKGROUND OF THE INVENTION

In the art of producing iron-based ductile alloys that are castable, there are certain end-product applications that require the use of an iron-based alloy that yields enhanced high temperature strength end-products. Such end-products are used in a wide range of applications, one of those including "hot-side" engine parts. Typical of such parts are turbochargers, center housings, back plates, exhaust manifolds, and integrated turbo-manifold components that are used in the automotive and truck manufacturing industries. As with any product in the automotive industry, the market for such products is quite large and the number of products that are required to be produced is proportionately large.

Molybdenum and niobium (also somewhat archaically known as "columbium") are alloying elements that are known in the art. Niobium is currently being used in the production of heat resistant stainless steels and aircraft engine parts. Molybdenum is also used in similar applications, but at a greater cost. Because niobium adjoins molybdenum in the periodic table, these elements have very similar atomic weights. The product of the present invention was intended to utilize niobium in such a way as to provide a high-silicon niobium ductile iron with acceptable heat-resistance properties with reduced cost in mind. That is, since large numbers of hot-side engine parts are used in the automotive industry, achieving sufficient high temperature strength while using niobium in place of molybdenum would contribute to reducing the cost of producing such parts. During testing, however, it was found that the alloy of the present invention not only met the requirement of achieving sufficient high temperature strength, but actually exceeded that requirement and ended up providing a unique high-silicon niobium ductile iron with enhanced heat-resistance characteristics, and with a probable saving of cost.

Another goal of the product of the present invention was to utilize niobium in such a high silicon casting alloy wherein existing industry-wide specifications and performance standards would be adhered to. More specifically, current high silicon molybdenum ductile alloys called out specific ranges for levels of certain elements to be used in the alloy and that the alloy would possess certain minimum performance characteristics following casting. This inventor was of the view that niobium could be used in a high silicon niobium alloy, at a savings of cost, while preserving the required performance characteristics that were dictated by the industry. Not only did this view prove to be true, but performance characteristics were found to be enhanced.

Still another goal of the product of the present invention was to utilize niobium in an ultra high silicon casting alloy wherein corrosion and oxidation resistance characteristics were improved. That is, where the addition of chromium in ultra high silicon molybdenum alloys results in improved oxidation and corrosion resistance, this inventor was also of the view that niobium could be used in an ultra high silicon and chromium ductile iron in place of molybdenum without any degradation of those characteristics. This view proved to be true and with performance actually being enhanced as well.

SUMMARY OF THE INVENTION

Accordingly, it is an object of the present invention to provide an enhanced high temperature strength ductile iron alloy comprising carbon in an amount of 2.6 to 3.5% by weight, silicon in an amount of 3.7 to 4.9% by weight, niobium in an amount of 0.45 to 1.0% by weight, manganese in an amount of 0.6% by weight or less, sulfur in an amount of 0.02% by weight or less, phosphorus in an amount of 0.02% by weight or less, nickel in an amount of 0.5% by weight or less, chromium in an amount of 1.0% by weight or less, magnesium in an amount of 0.1% by weight or less, and the balance iron with 0.05% by weight or less of any other single element, up to a combined total of 0.2% by weight of all such other elements. Typical for such other elements would be molybdenum and copper.

It is another object of the present invention to provide a heat-resistant ductile iron alloy that possesses high ductility and high creep stress rupture properties. The alloy of the present invention with targeted chemistry such as carbon at 3.0 to 3.3% by weight, silicon at 3.75 to 4.25% by weight and niobium at 0.5 to 0.7% by weight should, at room temperature, possess an ultimate tensile strength of 75,000 psi; a 0.2% offset yield strength of 60,000 psi; and percent elongation of 10%. Additionally, the Brinell Hardness Number (BHN) of the cast material must fall within the range of 187 to 241 BHN, the BHN expressing the hardness of the alloy as the ratio of the pressure applied to a steel ball forced in to the surface of the alloy to the surface area of the resulting indentation.

It is still another object of the present invention to provide the process for producing the enhanced high-temperature strength high-silicon ductile iron alloy of the present invention.

The composition of the present invention has obtained these objects. The product is formulated in accordance with the aforementioned percentages by weight and, when formulated this way, there results an enhanced high-temperature strength ductile iron alloy.

Further objects and advantages of the alloy and process of the present invention will become apparent from the detailed description that follows.

DETAILED DESCRIPTION OF THE INVENTION

Figure 1:
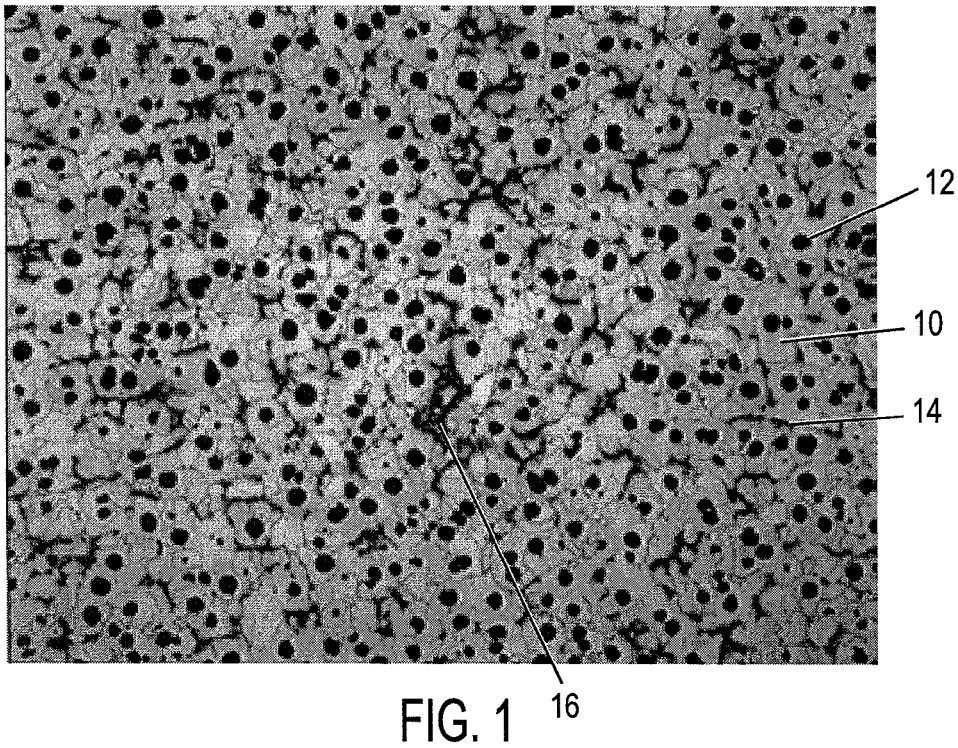
FIG. 1 is a photographic image at 100× magnification showing the microstructure of an etched sample of casting made with 0.56% molybdenum.

The alloy of the present invention is a high-silicon niobium ductile iron. As previously alluded to, niobium is an alloying element that is currently being used in the production of certain heat resistant stainless steels and aircraft engine parts. Niobium adjoins molybdenum in the periodic table and, as a result, these elements have very similar atomic weights. The industry standard that was used as a starting point for development of the niobium-add alloy of the present invention specifies carbon in an amount of 3.0 to 3.4% by weight, silicon in an amount of 3.75 to 4.25% by weight, molybdenum in an amount of 0.5 to 0.7% by weight, manganese in an amount of 0.6% by weight or less, sulfur in an amount of 0.07% by weight or less, phosphorus in an amount of 0.02% by weight or less, nickel in an amount of 0.5% by weight or less, magnesium in an amount of 0.08% by weight or less, and the balance iron.

The alloy of the present invention is an enhanced high temperature strength ductile iron alloy comprising carbon in an amount of 2.6 to 3.5% by weight, silicon in an amount of 3.7 to 4.9% by weight, niobium in an amount of 0.45 to 1.0% by weight, manganese in an amount of 0.6% by weight or less, sulfur in an amount of 0.02% by weight or less, phosphorus in an amount of 0.02% by weight or less, nickel in an amount of 0.5% by weight or less, chromium in an amount of 1.0% by weight or less, magnesium in an amount of 0.1% by weight or less, and the balance iron with 0.05% by weight or less of any other single element, up to a combined total of 0.2% by weight of all such other elements. Typical for such other elements would be molybdenum and copper.

Strength and Ductility Testing

Certain tests are used in the art to provide critical design information on the strength of materials, including materials such as the alloy of the present invention. For example, the high temperature progressive deformation of a material at constant stress is called "creep." In a "creep" test, a constant load is applied to a tensile specimen maintained at a constant temperature, such as room temperature. Strain is then measured over a period of time. When data is plotted in accordance with the measurements taken, a curve is formed which translates into the strain rate or the creep rate of the material. Stress rupture testing is similar to creep testing except that the stresses used are higher than in a creep test and is always done until the material fails.

Such tests are necessary to determine performance characteristics of alloys particularly when the alloys are intended, or specially designed, to be utilized in high temperature and high pressure systems. The gas turbine engine, for example, is one system that has several components that tend to experience creep which, again, tends to occur under load and at high temperatures. The alloy of the present invention has been specified by this inventor to be a heat-resistant ductile iron alloy that possesses higher ductility under conventional creep and stress rupture tests.

In the tests mentioned above, certain parameters are used to describe strength and ductility of a material, such as the alloy of the present invention. One strength parameter is the "ultimate tensile strength" (or "UTS"). The UTS is the stress limit at which the alloy actually breaks, with a sudden release of the stored elastic energy (i.e., by noise or heat) in the alloy. In accordance with the present invention, the alloy of the present invention should, at room temperature, possess a UTS of 75,000 psi. This could also be represented by the pressure equivalent of 75 KSI.

Another strength parameter is the "offset yield strength" of the alloy, which is determined by the amount of stress that corresponds to an intersection of the characteristic stress-strain curve mentioned above and a line drawn parallel to the elastic part of the curve, offset by a specified strain. In the United States, the offset is usually specified as a strain of 0.2% or 0.1%. The alloy of the present invention should, at room temperature, possess a 0.2% offset yield strength of 60,000 psi, or 60 KSI.

Ductility is a qualitative, but subjective, property of an alloy. The measurement of a material's ductility can be used to indicate the extent to which the material can be deformed without fracture. One conventional measure of ductility is the strain at fracture, which is usually called the "elongation." This measurement is obtained after fracture by putting the specimen back together and taking the elongation measurement. Because an appreciable fraction of the deformation will be concentrated in a "necked" region of the tension specimen, the value of percentage elongation will depend on the length over which the measurement is taken. The alloy of the present invention should, at room temperature, possess a percent elongation of 10%.

Finally, the Brinell Hardness Number (BHN) of the alloy of the present invention must fit within the range of 187 to 241 BHN, the BHN expressing the hardness of the alloy as the ratio of the pressure applied to a steel ball forced in to the surface of the alloy to the surface area of the resulting indentation.

Referring now to the figures, the alloy of the present invention will now be illustrated by examples which are for the purpose of illustration only and are not in any way to be considered as limiting. Multiple castings of each of the following melt samples were made. The first sample was a high-silicon molybdenum ductile iron with 0.56% molybdenum by weight. The second sample was a high-silicon niobium ductile iron with 0.46% niobium by weight. The third sample was a high-silicon high-niobium ductile iron with 0.67% niobium by weight. The fourth sample was a high-silicon ultra-high-niobium ductile iron with 0.94% niobium by weight. FIGS. 1 through 8 illustrate magnified images of each of the samples that have been etched by nital, a dilute mixture of nitric acid and alcohol.

Figure 2:
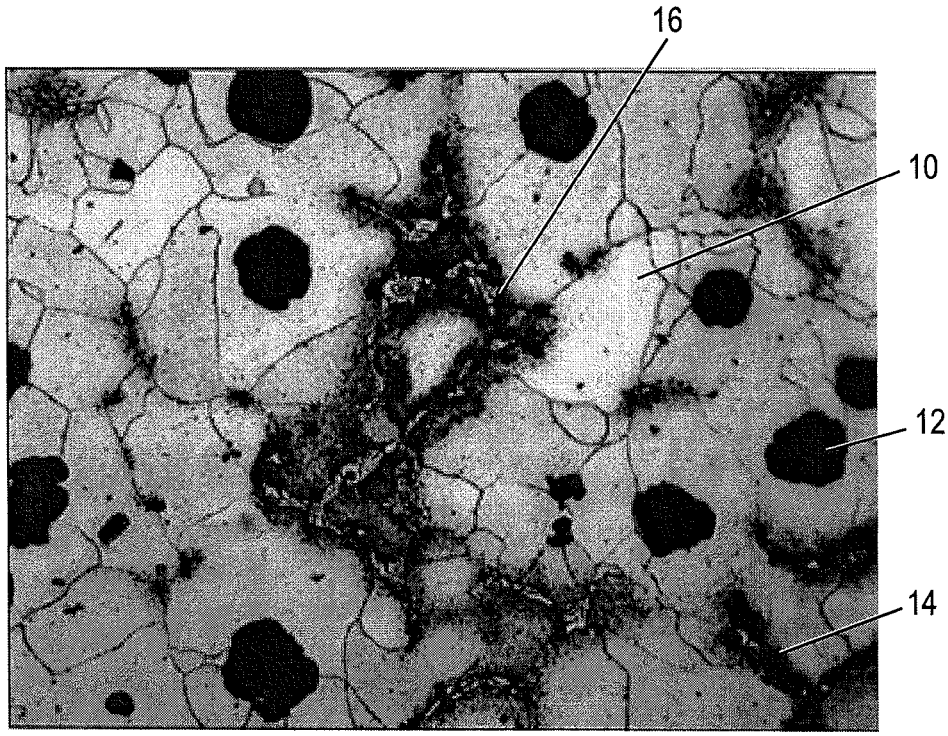
FIG. 2 is a photographic image at 500× magnification showing the microstructure of the casting sample illustrated in FIG. 1.

More specifically, FIG. 1 illustrates, at 100× magnification, one example of a nital-etched microstructure of an alloy of known art. This first sample, identified as the high-silicon molybdenum ductile iron above, was comprised, by weight, of 3.04% carbon, 3.94% silicon, 0.56% molybdenum, 0.39% manganese, 0.014% phosphorus, 0.006% sulfur, 0.039% magnesium, 0.072% nickel, and 0.015% niobium, the balance iron. At room temperature, the UTS of this high-silicon molybdenum alloy was 85.4 KSI, the 0.2% yield strength was 65.1 KSI, and the elongation percentage was 18%. The hardness was 196-235 BHN. FIG. 2 illustrates, at 500× magnification, the microstructure shown in FIG. 1. The sample illustrated in FIGS. 1 and 2 shows typical ferritic grain structure (10) and spheroidal graphites (12). Dispersed throughout this alloy sample are structures (14) of pearlite. Pearlite is a mixture of ferrite and cementite which forms in the alloy as it cools. While the presence of pearlite is desirable in cast ferrite alloys where pearlite is used as a means of increasing the hardness of the alloy, it is also undesirable in applications where higher ductility is desired since its presence also reduces ductility. With reduced ductility, the alloy, though harder, is also more prone to fracture, particularly at high temperatures. As shown in FIG. 1, the use of molybdenum in the sample alloy in the amount specified tends to produce pearlite amounts between 5% and 10%. Also dispersed throughout the sample are ill-defined gray areas (16) of intercellular complex carbides, which also adversely affect ductility.

Figure 3:
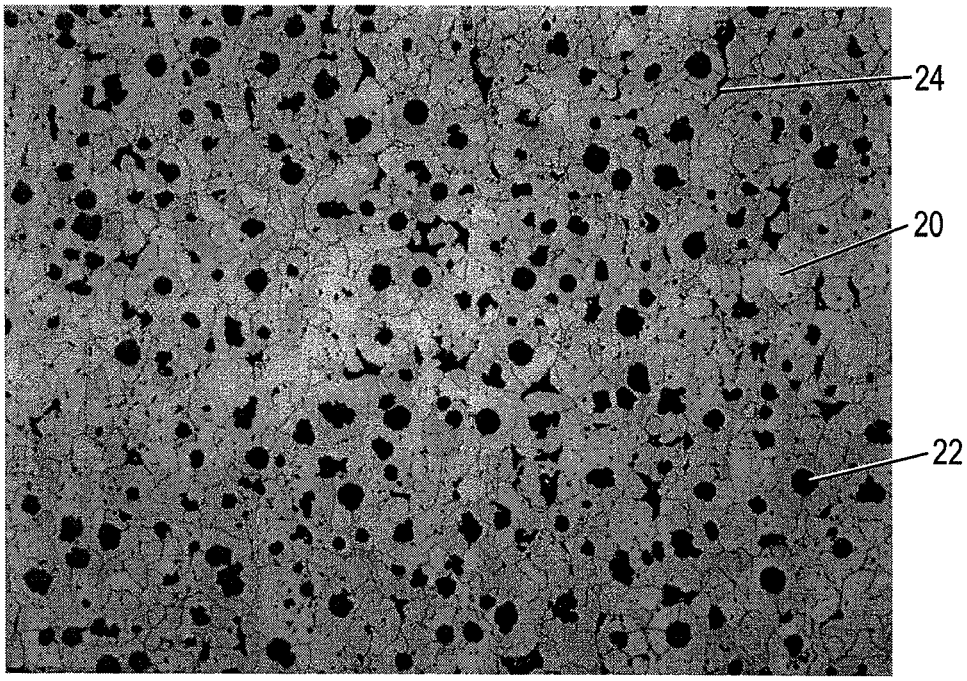
FIG. 3 is a photographic image at 100× magnification showing the microstructure of an etched sample of casting made according to the present invention with 0.46% niobium.
Figure 4:
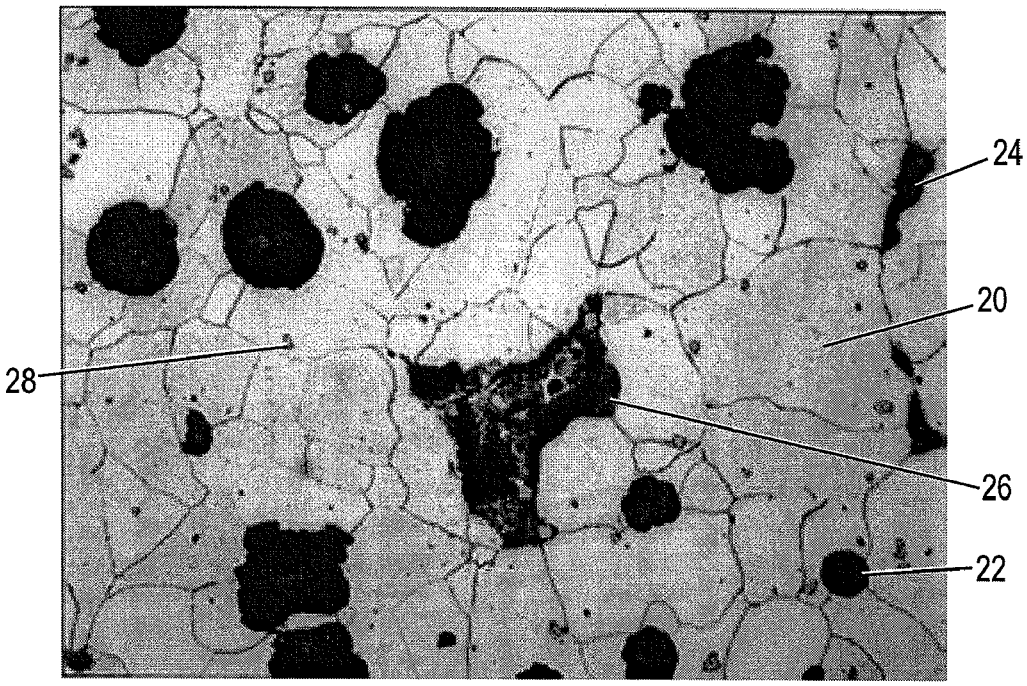
FIG. 4 is a photographic image at 500× magnification showing the microstructure of the casting sample illustrated in FIG. 3.

FIG. 3 illustrates, at 100× magnification, one example of a microstructure of an alloy according to the present invention which, by weight, was comprised of 3.08% carbon, 4.08% silicon, 0.03% molybdenum, 0.37% manganese, 0.009% phosphorus, 0.005% sulfur, 0.035% magnesium, 0.11% nickel, and 0.46% niobium, the balance iron. This example is referred to as the "second sample" above and was identified above as a high-silicon niobium ductile iron. The UTS of this alloy was 89.4 KSI, the 0.2% yield strength was 70.6 KSI, and the elongation percentage was 17%, all at room temperature. Its hardness was determined to be 196-235 BHN. FIG. 4 illustrates, at 500× magnification, the microstructure shown in FIG. 3. The high-silicon niobium sample illustrated in FIGS. 3 and 4 shows largely ferritic grain structure (20) and spheroidal graphites (22). Dispersed throughout the sample are black structures (24) of pearlite. A shown, the use of niobium at 0.46% tends to reduce the pearlite amounts to less than 5%. Also dispersed throughout the sample are ill-defined gray areas (26) of intercellular complex carbides and smaller niobium carbide globules (28).

Figure 5:
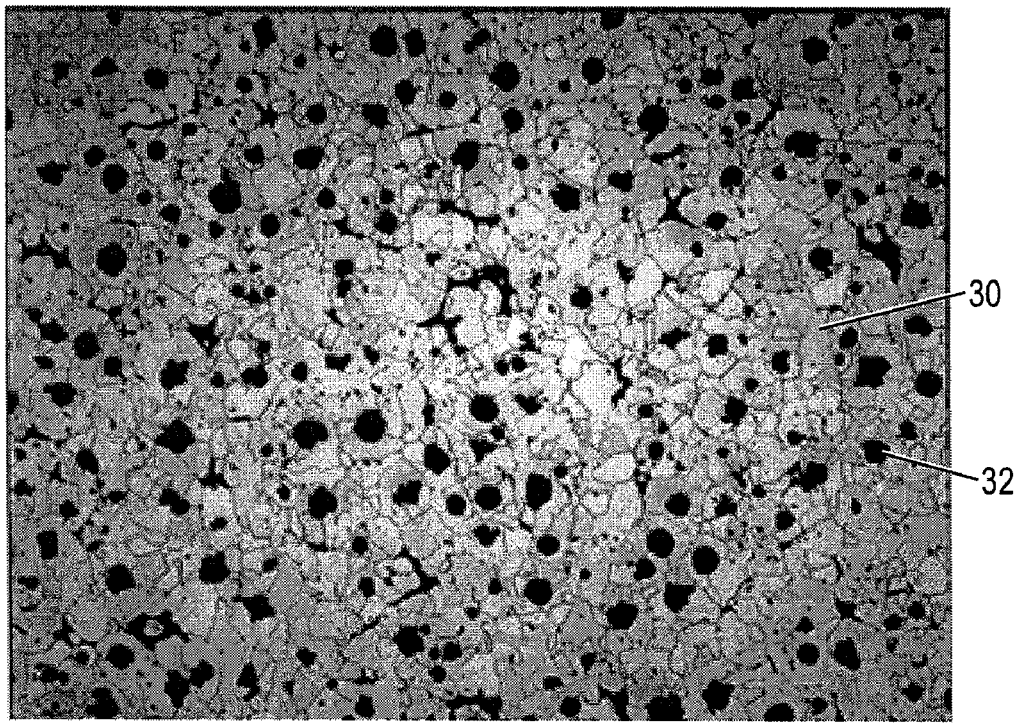
FIG. 5 is a photographic image at 100× magnification showing the microstructure of an etched sample of casting made according to the present invention with 0.67% niobium.
Figure 6:
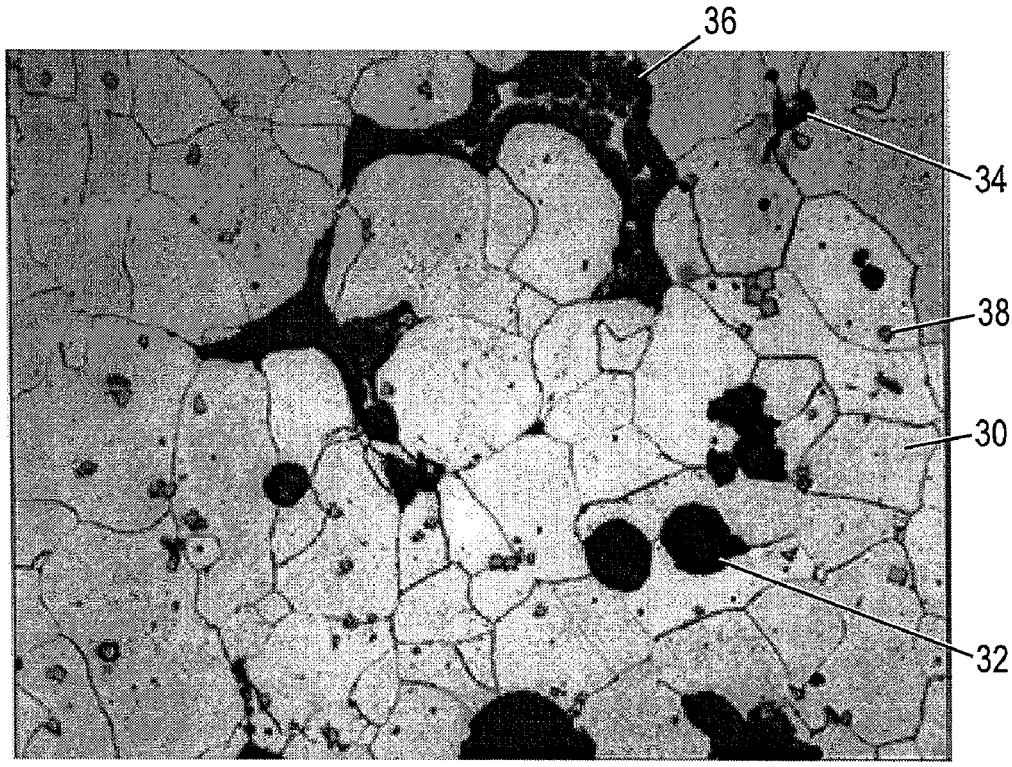
FIG. 6 is a photographic image at 500× magnification showing the microstructure of the casting sample illustrated in FIG. 5.

FIG. 5 illustrates, at 100× magnification, another example of a microstructure of an alloy according to the present invention which, by weight, was comprised of 3.19% carbon, 3.92% silicon, 0.04% molybdenum, 0.40% manganese, 0.009% phosphorus, 0.005% sulfur, 0.055% magnesium, 0.0784% nickel, and 0.67% niobium, the balance iron. This example is referred to as the "third sample" above and was identified above as a high-silicon high-niobium ductile iron. The UTS of this alloy was 83.5 KSI, the 0.2% yield strength was 64.0 KSI, and the elongation percentage was 19%, also all at room temperature. Its hardness was 196-235 BHN. FIG. 6 illustrates, at 500× magnification, the microstructure shown in FIG. 5. The high-silicon high-niobium sample illustrated in FIGS. 5 and 6 shows largely ferritic grain structure (30) and spheroidal graphites (32). Dispersed throughout the sample are black structures (34) of pearlite. A shown, the use of niobium at 0.67% tends to further reduce the pearlite amounts. Also dispersed throughout the sample are ill-defined gray areas (36) of intercellular complex carbides and smaller niobium carbide globules (38).

Figure 7:
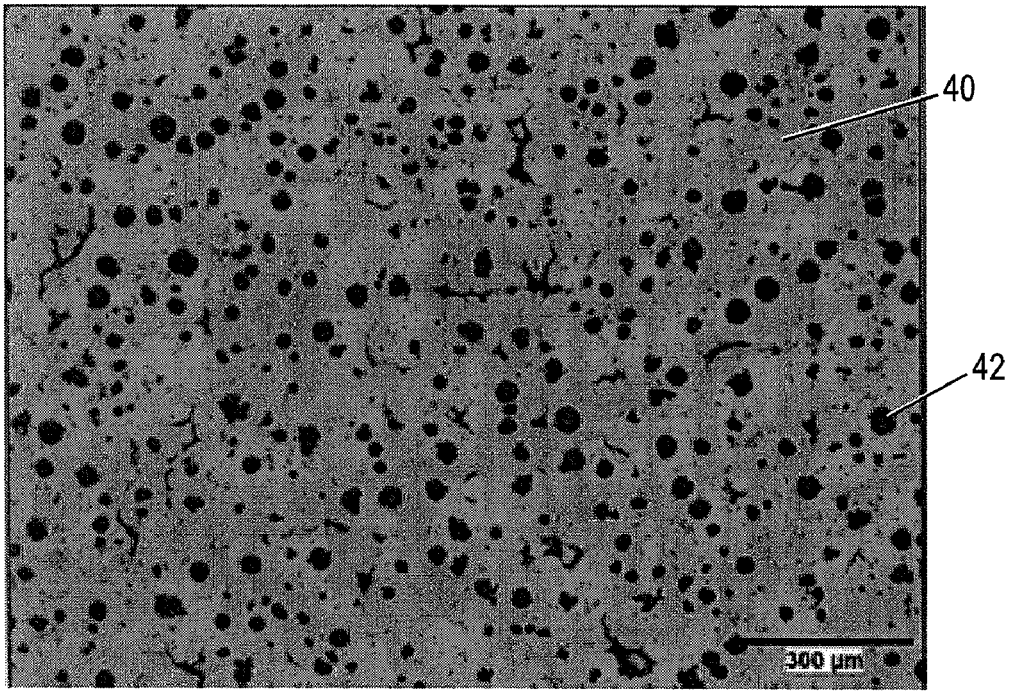
FIG. 7 is a photographic image at 100× magnification showing the microstructure of an etched sample of casting made according to the present invention with 0.94% niobium.
Figure 8:
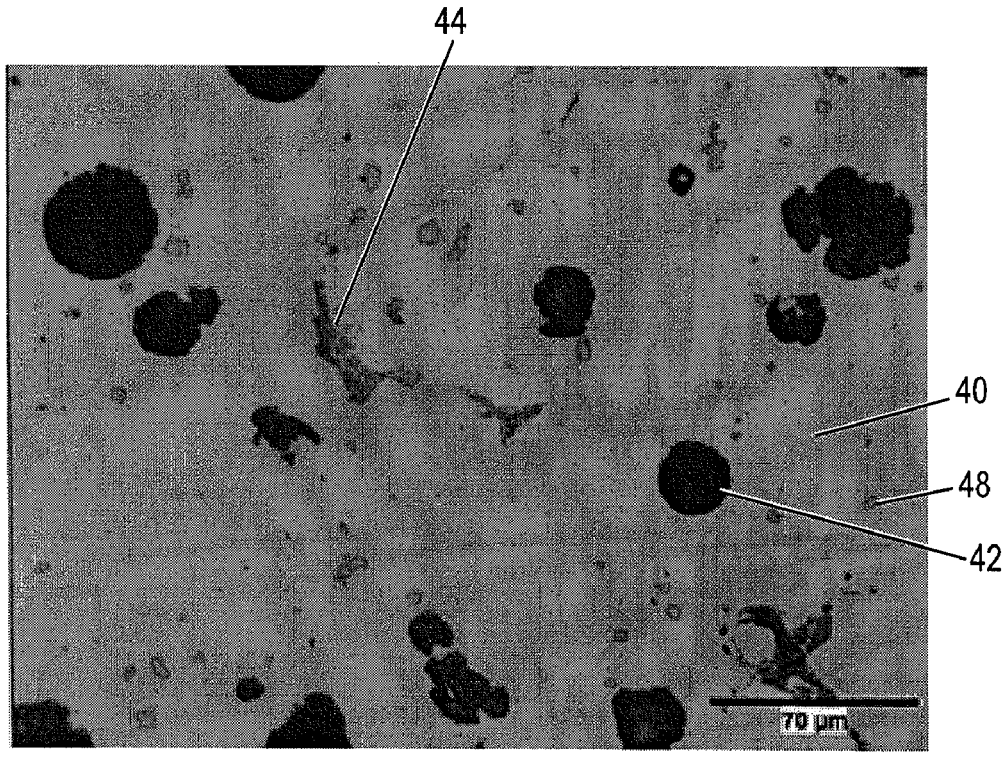
FIG. 8 is a photographic image at 500× magnification showing the microstructure of the casting sample illustrated in FIG. 7.

FIG. 7 illustrates, at 100× magnification, yet another example of a microstructure of an alloy according to the present invention which, by weight, was comprised of 3.36% carbon, 3.91% silicon, 0.02% molybdenum, 0.32% manganese, 0.013% phosphorus, 0.008% sulfur, 0.042% magnesium, 0.04% nickel, and 0.94% niobium, the balance iron. This example is referred to as the "fourth sample" above and was identified above as a high-silicon ultra-high-niobium ductile iron. At room temperature, the UTS of this alloy was 85.0 KSI, the 0.2% yield strength was 66.5 KSI, and the elongation percentage was 16%. Its hardness was 196-235. FIG. 8 illustrates, at 500× magnification, the microstructure shown in FIG. 7. The high-silicon ultra-high-niobium sample illustrated in FIGS. 7 and 8 shows largely ferritic grain structure (40) and spheroidal graphites (42). Dispersed throughout the sample are black structures (44) of pearlite. A shown, the use of niobium at 0.94% tends to reduce the pearlite amounts even further. Also dispersed throughout the sample are niobium carbide globules (48). But note that there is no sign of intercellular complex carbides in this sample.

As a general observation during testing of each of the above-mentioned specimens, it was noted that the machining characteristics of the high-silicon niobium ductile iron of the present invention were superior to those of the high-silicon molybdenum alloy. Also, the high-silicon niobium ductile iron of the present invention provided considerably higher ductility and creep stress rupture properties up to 800° C. than did the high-silicon molybdenum ductile iron.

High Temperature Testing

The samples of the high-silicon molybdenum, the high-silicon niobium, and the high-silicon high-niobium alloys were each tested for their respective UTS, 0.02% offset yield, elongation percentage and "reduction of area" percentage values at temperature increments of 100° C. The high-silicon ultra-high-niobium alloy was tested only at room temperature, as referred to above, and at 800° C., the extreme ends of this high temperature testing.

Figure 9:
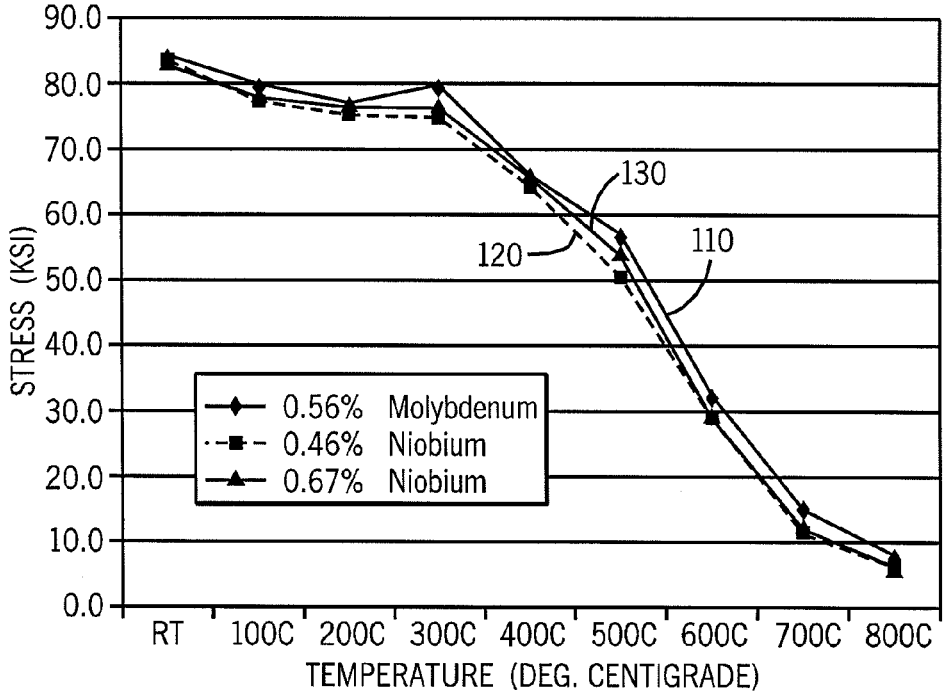
FIG. 9 is a graph illustrating the ultimate tensile strength of the casting sample illustrated in FIGS. 1 and 2 as compared to the ultimate tensile strength of the casting samples made according to the present invention with 0.46% and 0.67% niobium.
Figure 10:
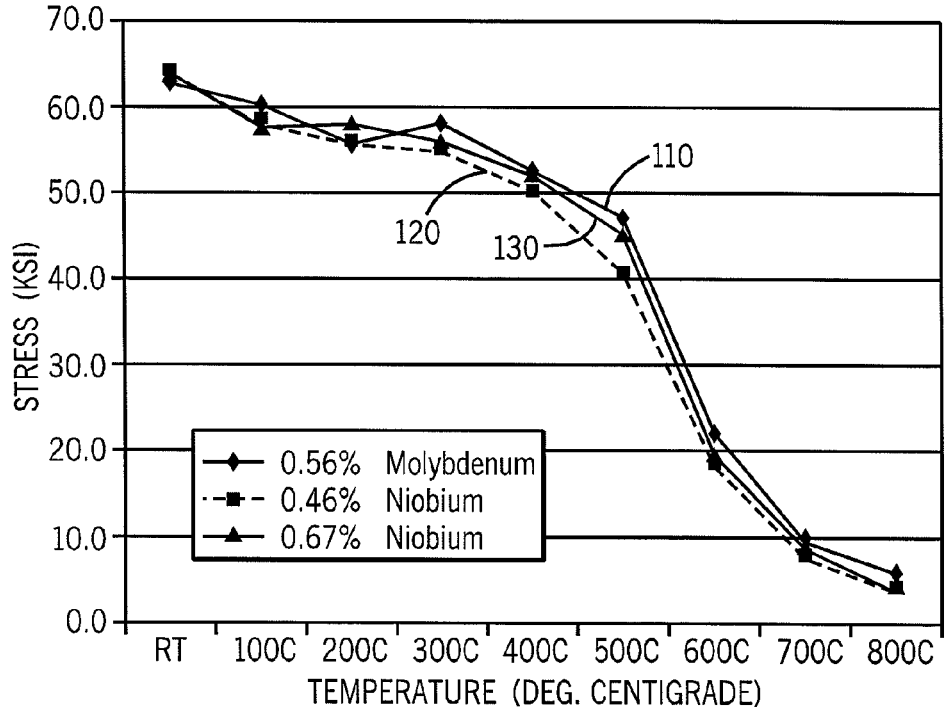
FIG. 10 is a graph illustrating the 0.2% method yield strength of the casting sample illustrated in FIGS. 1 and 2 as compared to the 0.2% method yield strength of the casting samples made according to the present invention with 0.46% and 0.67% niobium.
Figure 11:
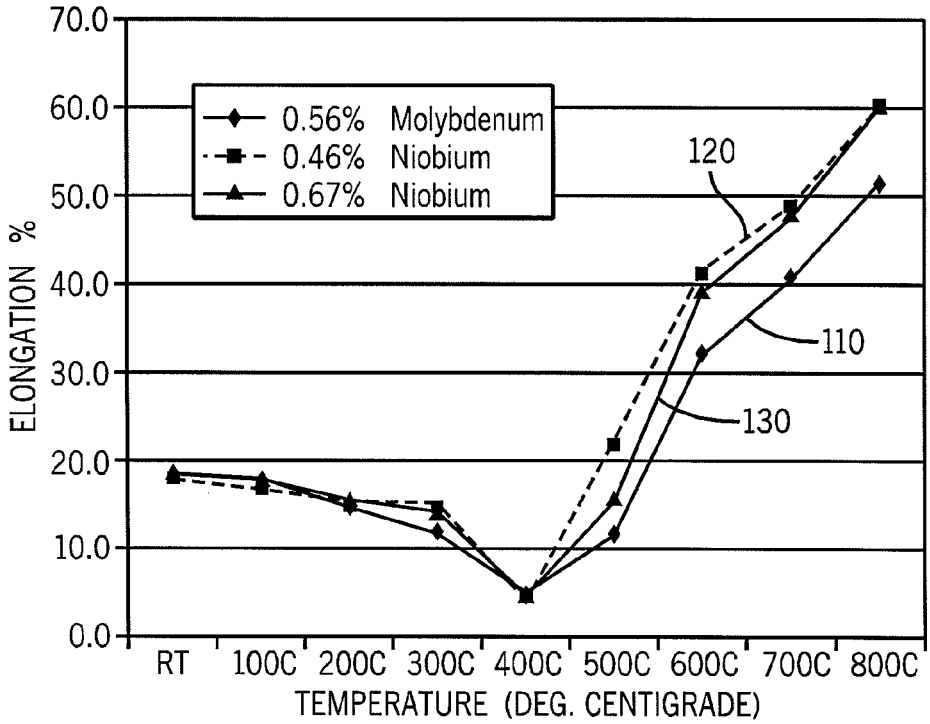
FIG. 11 is a graph illustrating the elongation percentage of the casting sample illustrated in FIGS. 1 and 2 as compared to the elongation percentage of the casting samples made according to the present invention with 0.46% and 0.67% niobium.
Figure 12:
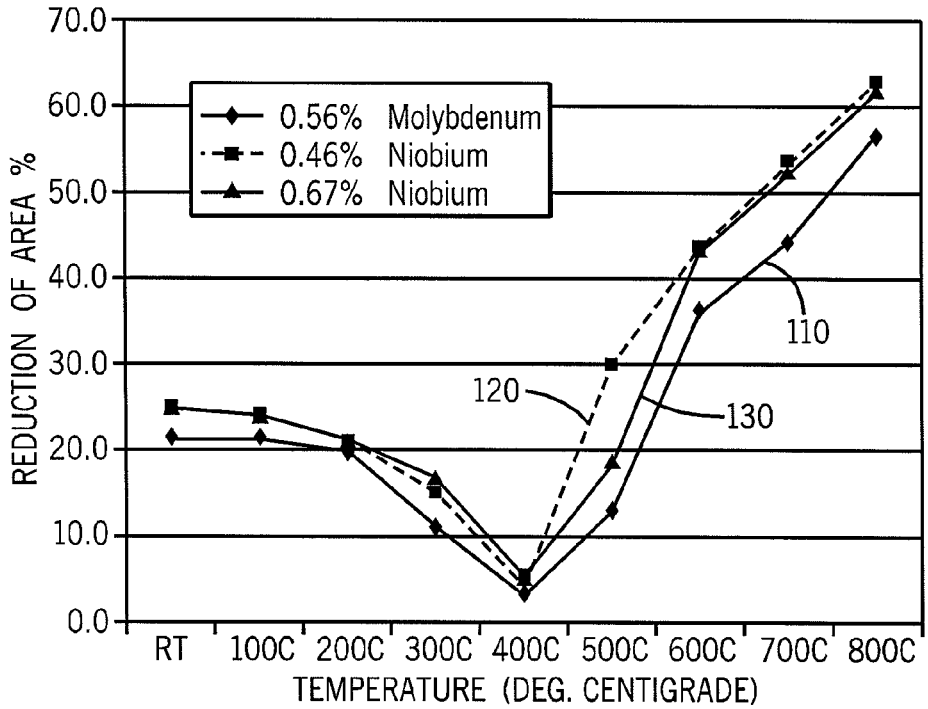
FIG. 12 is a graph illustrating the reduction of area of the casting sample illustrated in FIGS. 1 and 2 as compared to the reduction of area of the casting samples made according to the present invention with 0.46% and 0.67% niobium.

As shown in FIGS. 9 through 12, the performance characteristics of the first three samples are illustrated in graphical form based on test results measured in 100° C. increments. Specifically, those include the 0.56% molybdenum alloy, the 0.46% niobium alloy and the 0.67 high-niobium alloy. FIG. 9 represents the UTS of those samples and FIG. 10 represents the 0.2% yield strength of each. Recall that these values represent the relative "strength" of the alloys. FIG. 11 represents the elongation percentage and FIG. 12 represents the "reduction of area percentage" values, also measured in 100° C. increments. These last two graphs illustrate the relative "ductility" of the respective alloys. It should also be mentioned here that the "reduction of area percentage" value is a measure of the relative area of the "neck" of the specimen at the point of fracture as compared to the area of the pre-stressed specimen.

In each figure, the values of the 0.56% molybdenum alloy (110) are shown plotted against those of the 0.46% niobium alloy (120) and the 0.67% high-niobium alloy (130). As shown in FIGS. 9 and 10, it is evident that the "hardness" of the molybdenum alloy (110) is somewhat greater than that of either the niobium alloy (120) or the high-niobium alloy (130). However, it is also evident, in FIGS. 11 and 12, that the "ductility" of the molybdenum alloy (110) is substantially less than that of either the niobium allow (120) or the high-niobium alloy (130), particularly at higher temperatures.

High Temperature Soak Testing

Normalizing is a type of heat treatment applicable to ferrous metals only. Normalization involves the austenitizing of the ductile iron casting, followed by cooling in air through a critical temperature. The casting is normalized by means of "soaking" the casting within a heated environment for a predetermined period of time. A ductile iron casting is normalized in order to break down carbides, to increase strength, and to remove the internal stresses that are induced within the casting and which are brought about by the casting process itself.

High temperature testing of the molybdenum alloy and the niobium alloys also yielded specific average values of the strength and ductility test results following heat soaking of the alloys at 750° C. for 200 hours. The samples were then allowed to cool to room temperature. The samples were then tested for strength and ductility at room temperature and at 800° C.

At room temperature, the average UTS of the molybdenum alloy was 81.3 KSI. The average UTS for the niobium alloy was 82.7 KSI and for the high-niobium alloy was 82.8 KSI. At room temperature, the average 0.2% offset yield of the molybdenum alloy was 62.5 KSI. The 0.2% offset yield of the niobium alloy was 64.2 KSI and of the high-niobium alloy was 64.5% KSI. Accordingly, the high temperature soaking resulted in the niobium addition alloys being slightly stronger at room temperature.

At room temperature, the average elongation percentage of the molybdenum alloy was 17%. The average elongation percentage for the niobium alloy was 18% and for the high-niobium alloy was also 18%. At room temperature, the reduction of area percentage of the molybdenum alloy was 24%. The reduction of area percentage of the niobium alloy was 26% and of the high-niobium alloy was 25%. Accordingly, the high temperature soaking also resulted in the niobium addition alloys being slightly more ductile at room temperature.

At 800° C., the average UTS of the molybdenum alloy was 5.8 KSI. The average UTS for the niobium alloy was 5.2 KSI and for the high-niobium alloy was 5.7 KSI. At 800° C., the average 0.2% offset yield of the molybdenum alloy was 4.0 KSI. The 0.2% offset yield of the niobium alloy was 3.5 KSI and of the high-niobium alloy was 3.8% KSI. Accordingly, the high temperature soaking resulted in the niobium addition alloys yielding slightly less strength at higher temperature than the molybdenum addition alloy.

At 800° C., the average elongation percentage of the molybdenum alloy was 57%. The average elongation percentage for the niobium alloy was 65% and for the high-niobium alloy was 61%. At 800° C., the reduction of area percentage of the molybdenum alloy was 60%. The reduction of area percentage of both the niobium and the high-niobium alloys was 63%. Accordingly, the high temperature soaking also resulted in the niobium addition alloys being significantly more ductile at high temperatures.

Figure 13:
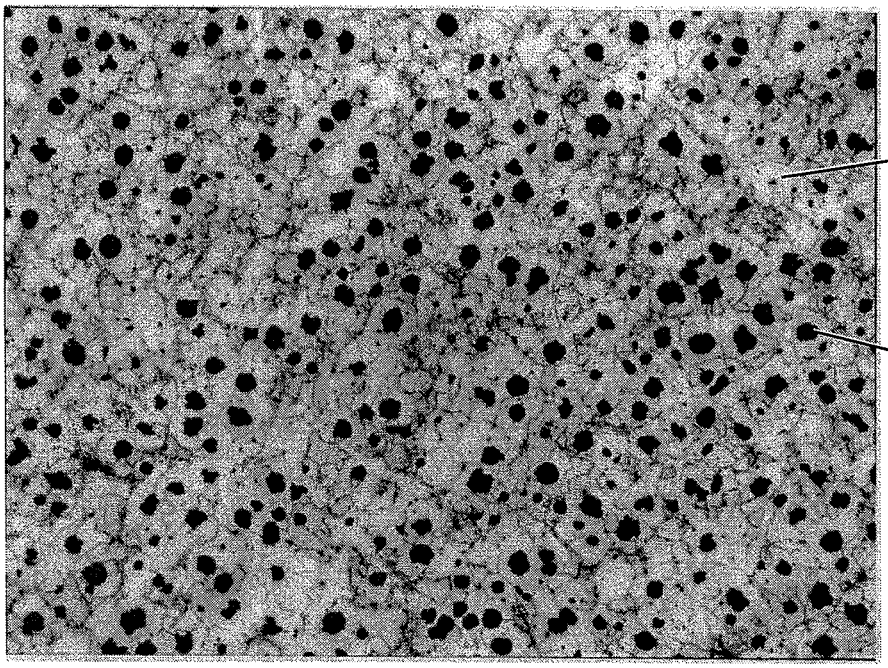
FIG. 13 is a photographic image at 100× magnification showing the microstructure of an etched sample of casting made with 0.56% molybdenum following heat soaking at 750° C. for 200 hours.
Figure 14:
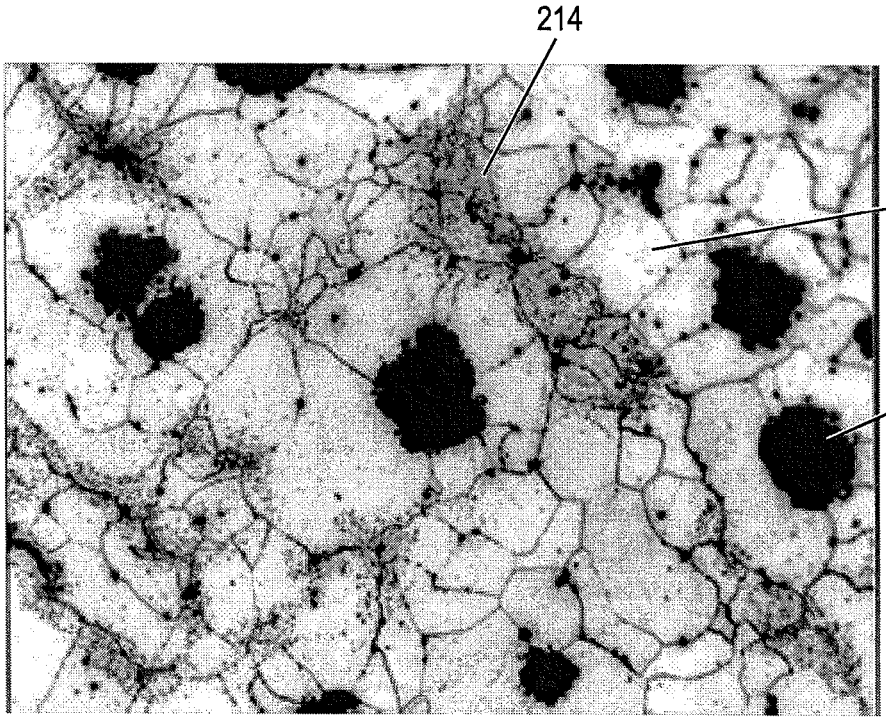
FIG. 14 is a photographic image at 500× magnification showing the microstructure of the casting sample illustrated in FIG. 13.

FIGS. 13 through 18 illustrate magnified images of each of the heat-soaked samples that have also been nital-etched. More specifically, FIG. 13 illustrates, at 100× magnification, the first sample of high-silicon molybdenum ductile iron. FIG. 14 illustrates, at 500× magnification, the microstructure shown in FIG. 13. Both microstructures illustrated in FIGS. 13 and 14 at 100× and 500× show basically ferritic grain structures (210) and spheroidal graphites (212) that are dispersed throughout the sample. Note also the presence of intercellular complex carbides (214), particularly in FIG. 14.

Figure 15:
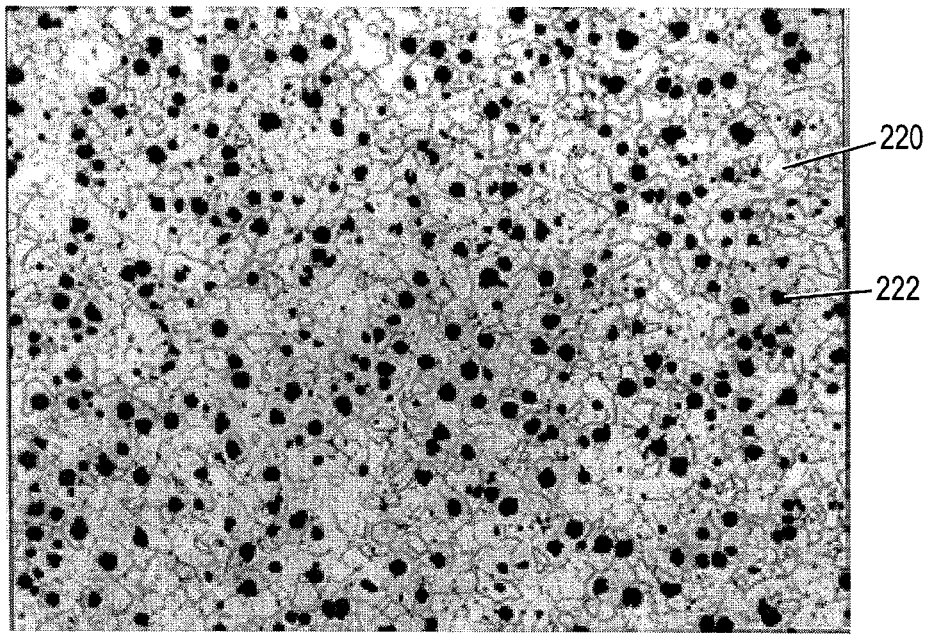
FIG. 15 is a photographic image at 100× magnification showing the microstructure of an etched sample of casting made according to the present invention with 0.46% niobium following heat soaking at 750° C. for 200 hours.
Figure 16:
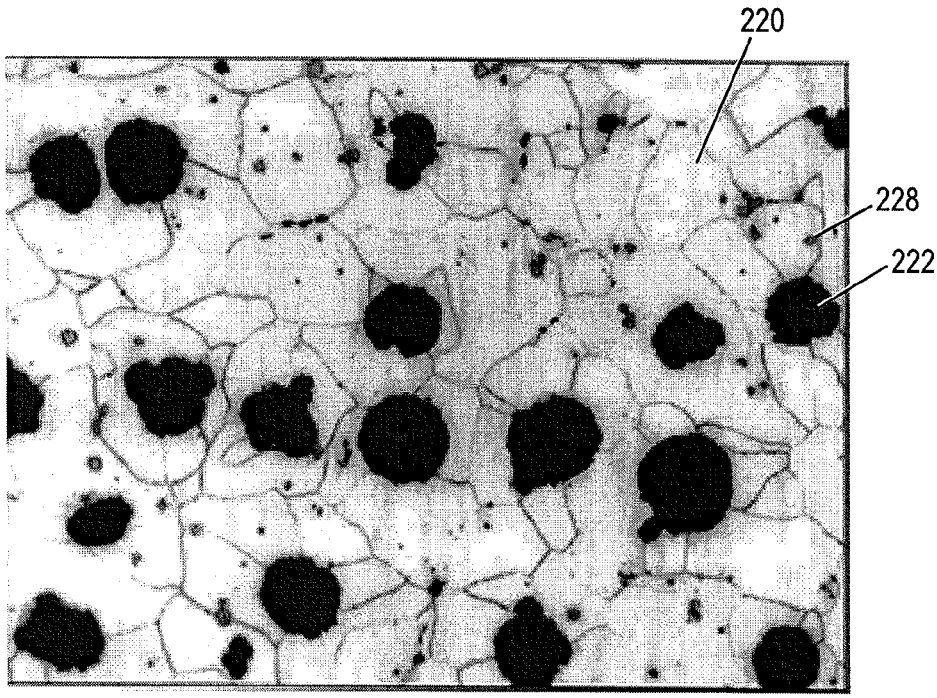
FIG. 16 is a photographic image at 500× magnification showing the microstructure of the casting sample illustrated in FIG. 15.

FIG. 15 illustrates, at 100× magnification, the heat-soaked high-silicon niobium ductile iron. FIG. 16 illustrates, at 500× magnification, the microstructure shown in FIG. 15. The high-silicon niobium sample illustrated in FIGS. 15 and 16 shows basically ferritic grain structures (220) and spheroidal graphites (222). Also dispersed throughout the sample are niobium carbide globules (228). Note the absence of intercellular complex carbides in this sample.

Figure 17:
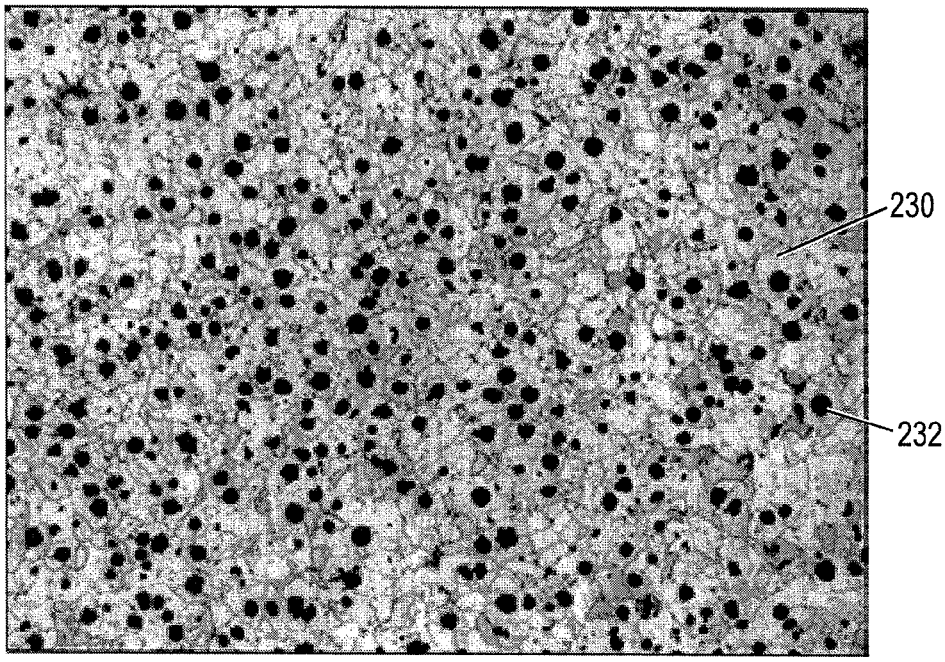
FIG. 17 is a photographic image at 100× magnification showing the microstructure of an etched sample of casting made according to the present invention with 0.67% niobium following heat soaking at 750° C. for 200 hours.
Figure 18:
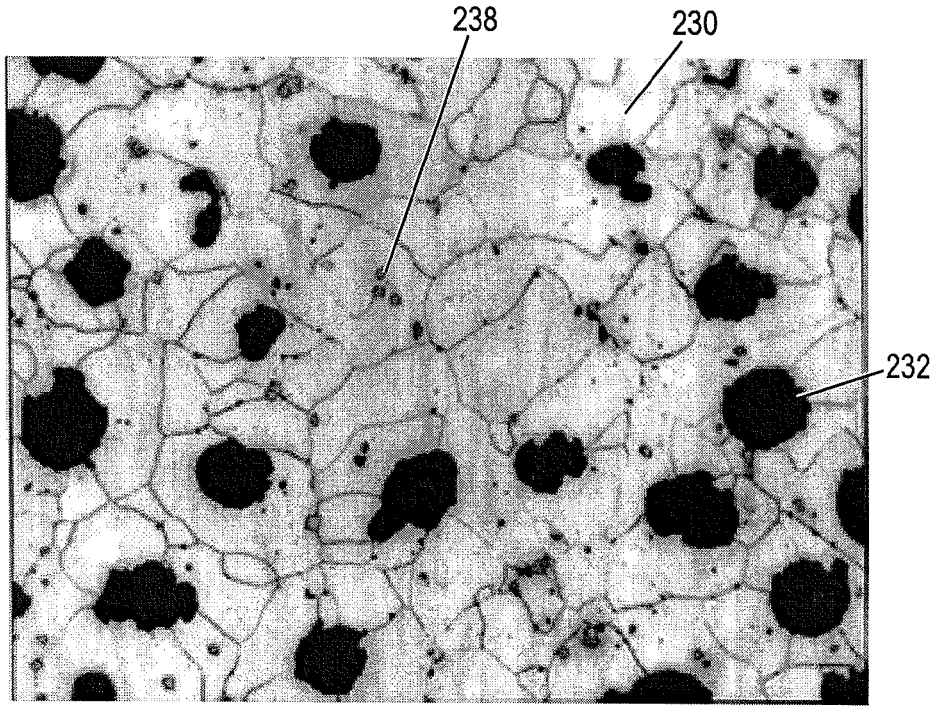
FIG. 18 is a photographic image at 500× magnification showing the microstructure of the casting sample illustrated in FIG. 17.

FIG. 17 illustrates, at 100× magnification, the heat-soaked high-silicon high-niobium ductile iron. FIG. 18 illustrates, at 500× magnification, the microstructure shown in FIG. 17. The high-silicon high-niobium sample illustrated in FIGS. 17 and 18 shows basically ferritic grain structures (230) and spheroidal graphites (232). Also dispersed throughout the sample are niobium carbide globules (238). Note the absence of intercellular complex carbides in this sample as well.

Specific Product Testing

To further evaluate the abilities of the high-silicon niobium addition alloy of the present invention, two specially designed melts were created. A turbocharger was selected as the test casting due to its affinity for cracks propagating through the divider wall and tongue area when run on an engine test at high temperature. Sample batches of high-silicon molybdenum alloy and high-silicon niobium alloy were used. The high-silicon molybdenum alloy had a chemical composition, by weight, of 3.12% carbon, 3.98% silicon, 0.57% molybdenum, 0.35% manganese, 0.012% phosphorus, 0.007% sulfur, 0.041% magnesium, 0.09% nickel, 0.01% niobium, and the balance iron. The high-silicon niobium alloy had a chemical composition, by weight, of 3.15% carbon, 4.17% silicon, 0.02% molybdenum, 0.32% manganese, 0.014% phosphorus, 0.009% sulfur, 0.039% magnesium, 0.14% nickel, 0.6% niobium, and the balance iron. The relative hardness of the high-silicon molybdenum alloy ranged between 217 BHN and 228 BHN. The high-silicon niobium alloy had a relative hardness of between 207 BHN and 228 BHN.

Figure 19:
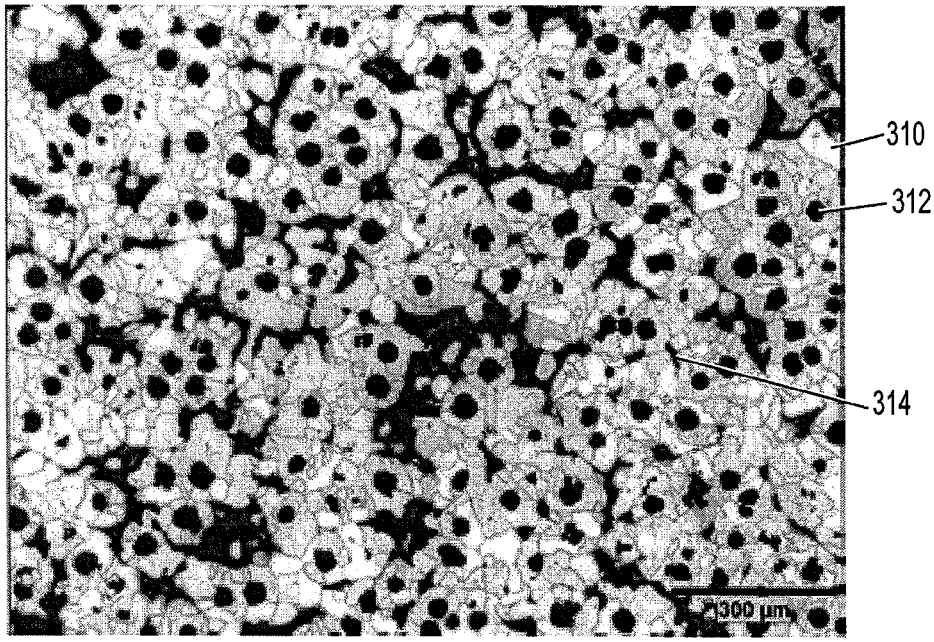
FIG. 19 is a photographic image at 100× magnification showing the microstructure of an etched sample of a cast turbocharger divider wall made with 0.57% molybdenum.
Figure 20:
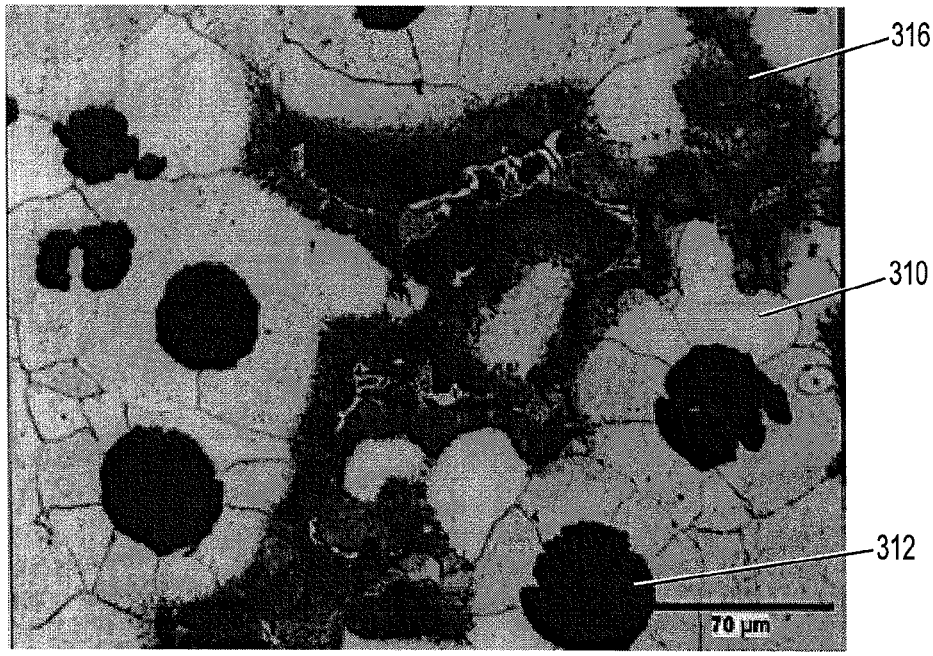
FIG. 20 is a photographic image at 500× magnification showing the microstructure of the casting sample illustrated in FIG. 19.

FIGS. 19 through 22 illustrate magnified images of each of the above-referenced samples that have also been nital-etched. More specifically, FIG. 19 illustrates, at 100× magnification, the first sample of the casting divider wall made with the high-silicon molybdenum ductile iron, with 0.57% molybdenum. FIG. 20 illustrates, at 500× magnification, the microstructure shown in FIG. 19. The sample illustrated in FIGS. 19 and 20 shows ferritic grain structure (310) and spheroidal graphites (312) along with well-defined black structures (314) of pearlite. Also dispersed throughout the sample are a larger number of ill-defined gray areas (316) of intercellular complex carbides.

Figure 21:
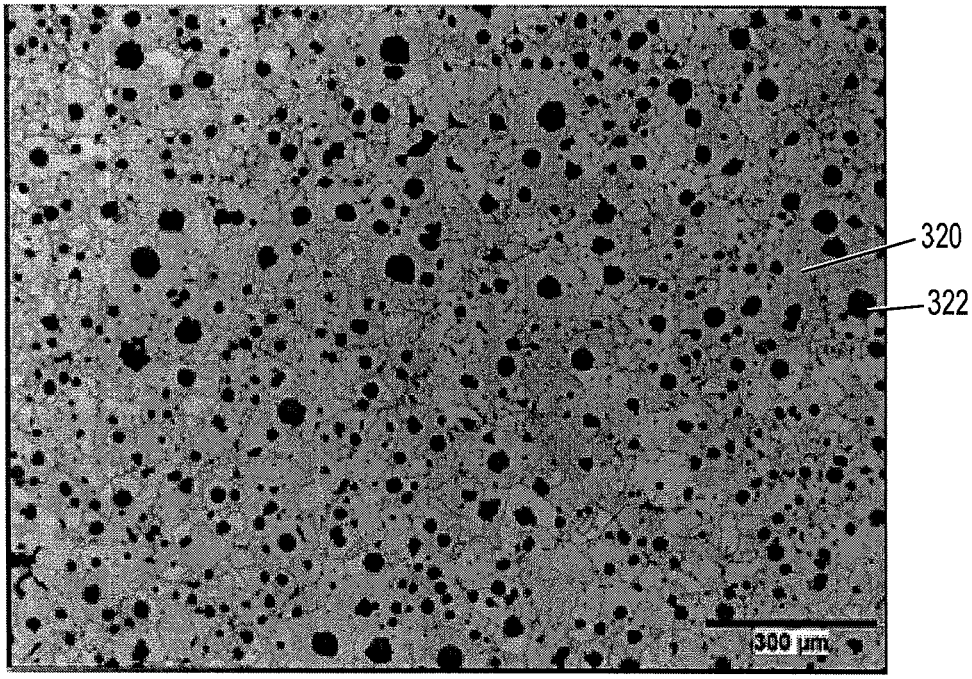
FIG. 21 is a photographic image at 100× magnification showing the microstructure of an etched sample of a cast turbocharger divider wall made according to the present invention with 0.60% niobium.
Figure 22:
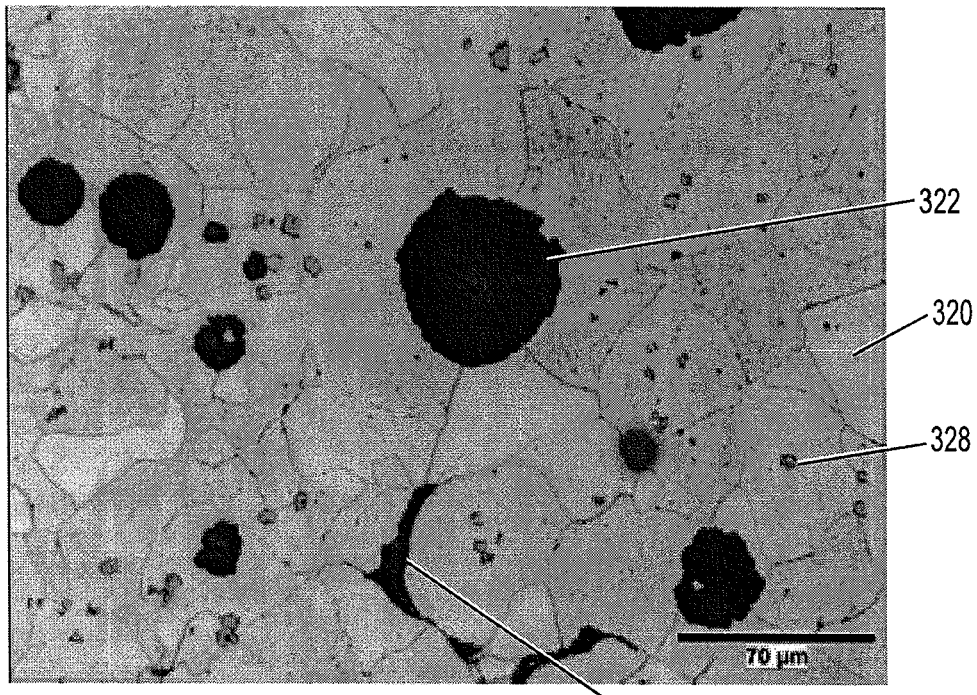
FIG. 22 is a photographic image at 500× magnification showing the microstructure of the casting sample illustrated in FIG. 21.

FIG. 21 illustrates, at 100× magnification, the casting divider sample made of high-silicon niobium ductile iron, with 0.60% niobium. FIG. 22 illustrates, at 500× magnification, the microstructure shown in FIG. 21. The high-silicon niobium sample illustrated in FIGS. 21 and 22 shows largely ferritic grain structure (320) and spheroidal graphites (322) with very low percent, less than 2%, pearlite (324) with no sign of intercellular complex carbides. Along with these structures are niobium carbide globules (328) dispersed throughout the sample, the presence of which is good because such globules (328) will not break down during useful application of the structure.

Corrosion and Oxidation Resistance

As demonstrated above, testing of the niobium-add alloy proved that the alloy had a better microstructure containing very low, if any, pearlite and carbide content and that it had excellent ductility and creep rupture properties. It is known in the art that chromium added to an iron-based ductile alloy improves oxidation and corrosion resistance properties of the alloy. In view of that art, this inventor produced an ultra high silicon niobium and chromium alloy to determine whether those properties would be affected by the substitution of niobium for molybdenum in this type of alloy. The specification target that was used as a starting point for development of the ultra high silicon niobium and chromium alloy of the present invention specifies carbon in an amount of 2.8 to 2.9% by weight, silicon in an amount of 4.4 to 4.8% by weight, molybdenum in an amount of 0.05% by weight or less, niobium in an amount of 0.6 to 0.8% by weight, chromium in an amount of 0.75 to 0.9% by weight, manganese in an amount of 0.4% by weight or less, sulfur in an amount of 0.02% by weight or less, phosphorus in an amount of 0.04% by weight or less, nickel in an amount of 0.5% by weight or less, copper in an amount of 0.03 to 0.07% by weight, magnesium in an amount of 0.03 to 0.07% by weight or less, and the balance iron.

Figure 23:
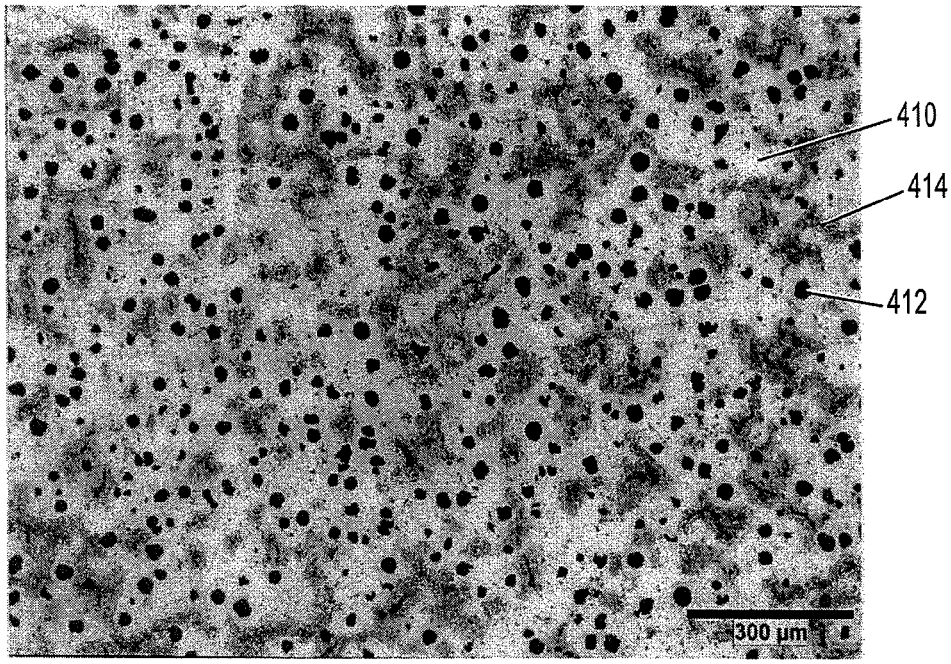
FIG. 23 is a photographic image at 100× magnification showing the microstructure of an etched sample of a cast turbocharger divider wall made according to the present invention with ultra high silicon at 4.67%, with 0.77% niobium and with higher end of chromium at 0.87%.
Figure 24:
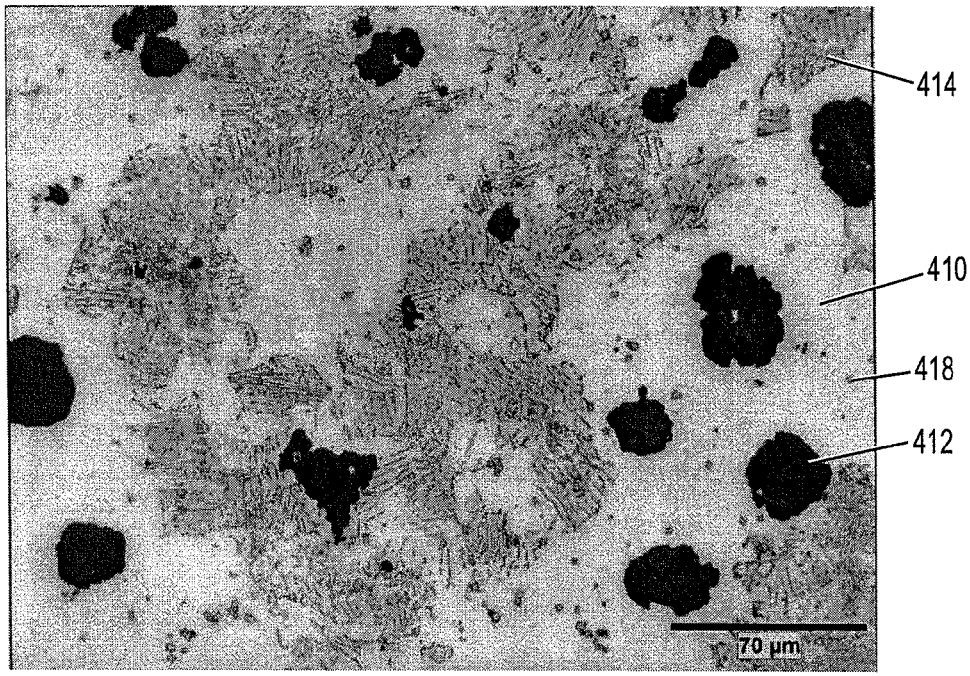
FIG. 24 is a photographic image at 500× magnification showing the microstructure of the casting sample illustrated in FIG. 23.

The heat of ultra high silicon niobium and higher end chromium alloy that was used in pouring turbocharger castings made according to the present invention is illustrated in FIGS. 23 and 24 which show magnified images of the heat treated sample that has been nital-etched. The final chemistry of this sample was, by weight, 2.79% carbon, 4.67% silicon, 0.77% niobium, 0.87% chromium, 0.04% molybdenum, 0.34% manganese, 0.01% phosphorus, 0.01% sulfur, 0.03% magnesium, 0.08% nickel, and 0.05% copper, the balance iron. The mechanical properties of the fully annealed heat treated sample yielded a UTS of 100 to 114 KSI, a 0.2% yield strength of 87 to 113 KSI, an elongation percentage of 9% and a hardness of 235 BHN. FIG. 23 illustrates the microstructure of this heat treated sample at 100× magnification. FIG. 24 illustrates, at 500× magnification, the microstructure shown in FIG. 23. The sample illustrated in FIGS. 23 and 24 shows typical ferritic grain structure (410) and spheroidal graphites (412). Dispersed throughout this alloy sample are chromium carbide structures (414) and niobium carbide globules (418). Note the complete absence of pearlite and intercellular complex carbides in this sample.

Figure 25:
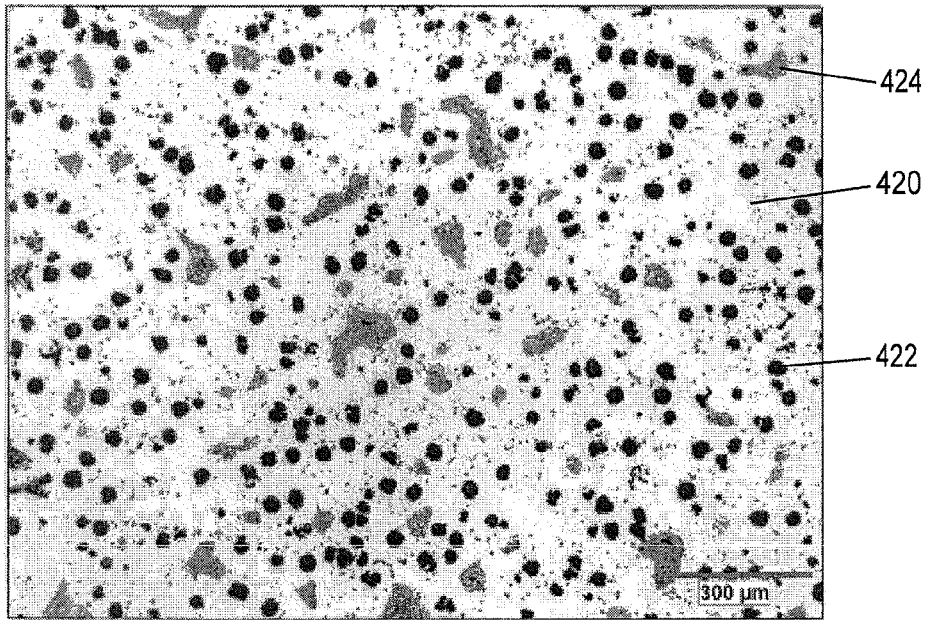
FIG. 25 is a photographic image at 100× magnification showing the microstructure of an etched sample of a cast turbocharger divider wall made according to the present invention with ultra high silicon at 4.45%, with 0.697% niobium and with lower end of chromium at 0.441%.
Figure 26:
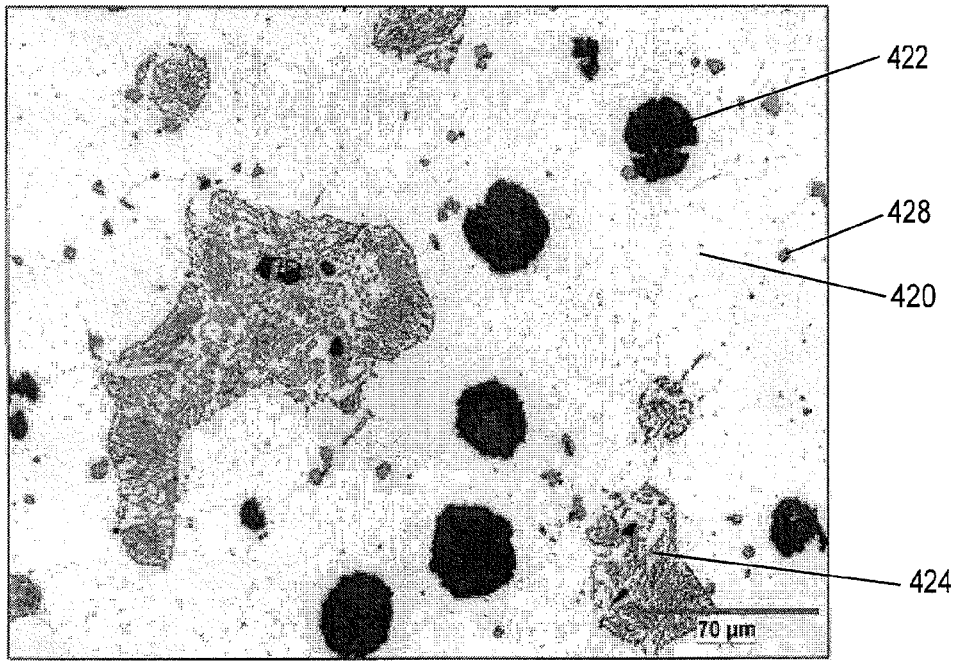
FIG. 26 is a photographic image at 500× magnification showing the microstructure of the casting sample illustrated in FIG. 25.

Another heat of ultra high silicon niobium and lower end chromium alloy was used to pour turbocharger castings also made according to the present invention is illustrated in FIGS. 25 and 26 which show magnified images of the second heat treated sample that has been nital-etched. FIG. 25 illustrates the microstructure of this heat treated sample at 100× magnification. FIG. 26 illustrates, at 500× magnification, the microstructure shown in FIG. 25. The sample illustrated in FIGS. 25 and 26 again shows typical ferritic grain structure (420) and spheroidal graphites (422). Dispersed throughout this alloy sample are chromium carbide structures (422) and niobium carbide globules (428). Note the complete absence of pearlite and intercellular complex carbides in this sample.

Conclusion Regarding Test Results

In the view of this inventor, the reason that the creep rupture test and ductility of the alloy shows a much increased result when using niobium over molybdenum is because of the fundamental microstructure differences between the molybdenum and niobium additions. For example, in the molybdenum addition alloy, molybdenum tends to produce more pearlite amounts, those amount being between 5% and 10%. The niobium addition, however, tends to produce much less than 5% pearlite in the microstructure. The molybdenum addition also tends to produce more intercellular complex carbides than the niobium addition. The reason for the occurrence of larger amounts of pearlite and intercellular complex carbides in the molybdenum addition is that, after graphite nodule formation, the molybdenum tends to combine with the free carbon to produce those items. In the niobium addition, niobium combines with carbon and produces niobium carbides in a very fine globule shape throughout the microstructure. The levels of pearlite and intercellular complex carbides in the molybdenum addition result is increased hardness and reduced ductility of the alloy at room temperature and at high temperatures along with lower creep stress rupture test results as is evident from the test results obtained. On the other hand, the end result in the niobium addition alloy is a reduction in hardness and an increase in ductility at room temperature and at high temperature along with higher creep stress rupture test results, also evident from the data collected.

In the molybdenum addition alloy, when pearlite and intercellular carbides break down at higher temperatures, there is an expansion in the component which creates deformation and cracking in the casting. However, in the niobium addition alloy, there is little, if any, break down which results in less deformation and cracking in the casting. This is due to the very low presence of pearlite and intercellular carbides in the niobium additions relative to the molybdenum addition and because the niobium carbides are very stable at high temperatures. The structural testing of these alloys also supports these test results.

The niobium-add alloy of the present invention also demonstrated enhanced performance properties when used in ultra high silicon chromium and ultra high silicon and ultra high chromium applications for corrosion and oxidation resistance.

Accordingly, it will be evident that there has been provided a new and useful high-silicon niobium ductile iron alloy that demonstrates enhanced high temperature strength and performance characteristics and a process for producing this alloy.

The principles of this invention having been fully explained in connection with the foregoing, I hereby claim as my invention:

1. An enhanced high temperature strength ductile iron alloy consisting of:

carbon in an amount of 2.79 to 2.9% by weight,
silicon in an amount of 4.17 to 4.67% by weight,
niobium in an amount of 0.6 to 0.77% by weight,
manganese in an amount of 0.6% by weight or less,
sulfur in an amount of 0.02% by weight or less.
phosphorus in an amount of 0.02% by weight or less,
nickel in an amount of 0.08 to 0.14% by weight or less,
chromium in an amount of 1.0% by weight or less,
magnesium in an amount of 0.1% by weight or less,
any other single element in an amount of 0.02 to 0.05% by weight, up to a combined total of 0.2% by weight of all such other elements, and
the balance iron.

2. A process for producing an enhanced high temperature strength ductile iron alloy consisting of the steps of:

providing carbon in an amount of 2.79 to 2.9% by weight,
providing silicon in an amount of 4.17 to 4.67% by weight,
providing niobium in an amount of 0.6 to 0.77% by weight,
providing manganese in an amount of 0.6% by weight or less,
providing sulfur in an amount of 0.02% by weight or less,
providing phosphorus in an amount of 0.02% by weight or less,
providing nickel in an amount of 0.08 to 0.14% by weight,
providing chromium in an amount of 1.0% by weight or less,
providing magnesium in an amount of 0.1% by weight or less,
providing 0.02 to 0.05% by weight of any other single element, up to a combined total of 0.2% by weight of all such other elements,
providing the balance iron,
combining the elements,
melting the combined elements, and
air cooling the alloy in the form of an end-product.

* * * * *

UNITED STATES PATENT AND TRADEMARK OFFICE

CERTIFICATE OF CORRECTION

PATENT NO. : 8,012,410 B2
APPLICATION NO. : 12/066974
DATED : September 6, 2011
INVENTOR(S) : Bipin H. Shah It is certified that error appears in the above-identified patent and that said Letters Patent is hereby corrected as shown below:

Col. 11, line 17, Claim 1, cancel the text beginning with "1. An enhanced high temperature strength ductile iron alloy" and ending "the balance iron." in col. 12, line 4, and insert the following claim:

--1. An enhanced high temperature strength ductile iron alloy consisting of:
carbon in an amount of 2.79 to 2.9% by weight,
silicon in an amount of 4.17 to 4.67% by weight,
niobium in an amount of 0.6 to 0.77% by weight,
manganese in an amount of 0.6% by weight or less,
sulfur in an amount of 0.02% by weight or less,
phosphorus in an amount of 0.02% by weight or less,
nickel in an amount of 0.08 to 0.14% by weight or less,
chromium in an amount of 1.0% by weight or less,
magnesium in an amount of 0.1% by weight or less,
any other single element in an amount of 0.02 to 0.05% by weight, up to a combined total of 0.2% by weight of all such other elements, and
the balance iron.--

Signed and Sealed this
Twentieth Day of December, 2011

David J. Kappos

David J. Kappos
*Director of the United States Patent and Trademark Office*